US007624773B2

(12) United States Patent
Maxwell

(10) Patent No.: US 7,624,773 B2
(45) Date of Patent: Dec. 1, 2009

(54) STANDALONE ICE DISPENSER

(76) Inventor: Tim Maxwell, 5714 Branchville Rd., Camilla, GA (US) 31730

( * ) Notice: Subject to any disclaimer, the term of this patent is extended or adjusted under 35 U.S.C. 154(b) by 167 days.

(21) Appl. No.: 11/804,315

(22) Filed: May 18, 2007

(65) Prior Publication Data

US 2008/0283145 A1 Nov. 20, 2008

(51) Int. Cl.
*B65B 1/10* (2006.01)
*B65B 1/30* (2006.01)
*B65B 1/32* (2006.01)

(52) U.S. Cl. ..... 141/114; 141/82; 141/98; 141/166; 141/317; 222/146.6; 222/167

(58) Field of Classification Search ..... 141/82, 141/98, 114, 165, 166, 313–317; 222/56, 222/146.6, 167
See application file for complete search history.

(56) References Cited

U.S. PATENT DOCUMENTS

| | | | | |
|---|---|---|---|---|
| 4,333,612 | A | 6/1982 | Hayashi | |
| 4,368,608 | A | 1/1983 | Ray | |
| 4,689,937 | A | 9/1987 | Finan, Sr. et al. | |
| 4,804,111 | A | 2/1989 | Ricciardi et al. | |
| 4,878,523 | A | 11/1989 | Balsamico et al. | |
| 5,079,897 | A | 1/1992 | Muller | |
| 5,109,651 | A | 5/1992 | Stuart | |
| 5,277,016 | A | 1/1994 | Williams et al. | |
| 5,458,851 | A | 10/1995 | Schroeder et al. | |
| 5,473,865 | A * | 12/1995 | Tanaka et al. | 53/502 |
| 5,581,982 | A | 12/1996 | Schroeder et al. | |
| 5,630,310 | A | 5/1997 | Chadwell | |
| 5,708,223 | A | 1/1998 | Wyss | |
| 5,806,576 | A | 9/1998 | Sutherlin | |
| 6,035,606 | A | 3/2000 | Bussey, III et al. | |
| 6,112,539 | A | 9/2000 | Colberg | |
| 6,266,945 | B1 | 7/2001 | Schroeder | |
| 6,904,946 | B2 * | 6/2005 | James | 141/82 |
| 6,932,124 | B2 | 8/2005 | Dalton et al. | |
| 7,062,892 | B2 * | 6/2006 | Metzger | 53/127 |
| 7,104,291 | B2 | 9/2006 | Dalton et al. | |
| 7,421,834 | B1 * | 9/2008 | Doolan | 53/570 |
| 2004/0084106 | A1 * | 5/2004 | James | 141/313 |
| 2006/0174969 | A1 | 8/2006 | Dalton et al. | |
| 2008/0110129 | A1 * | 5/2008 | LeBlanc et al. | 53/127 |

* cited by examiner

*Primary Examiner*—Timothy L Maust
*Assistant Examiner*—Nicolas A Arnett
(74) *Attorney, Agent, or Firm*—Peter Loffler

(57) ABSTRACT

A standalone ice dispenser delivers ice in either bagged form or bulk form to a user. The device uses a cone-shaped drum with an upwardly oriented mount that receives and stores the ice which ice is gravitationally delivered to the drum from an ice maker. When ice is to be dispensed, a motor rotates the drum such that a fin within the drum cause ice therein to advance toward and eventually out of the mouth of the drum into either a bagging system or directly out of the device via a chute. Weight sensors attached to the drum determine whether the drum is relatively empty or relatively full and control operation of the ice maker as a result and/or a proximity sensor measures the volume of ice in the drum and controls the operation of the ice maker.

10 Claims, 5 Drawing Sheets

STANDALONE ICE DISPENSER

BACKGROUND OF THE INVENTION

1. Field of the Invention

The present invention relates to a standalone ice dispenser that uses a simplified ice advancing mechanism.

2. Background of the Prior Art

Standalone ice dispensers have gained in popularity in recent times. These devices, which are typically placed in a parking lot or similar location, automatically sell ice to consumers without the need for an attendant to be present. The standalone ice dispenser, which is about the size of a large shed, is placed at the desired location and is hooked up to a local water supply and to a source of electricity. Once operational, the ice dispenser manufactures ice, which ice is sold to consumers by having the consumer approach the device and place money into an appropriate receiver, in similar fashion to the operation of a soda machine. Once the funds are received by the machine, a quantity of ice is measured out and is dispensed to the consumer, typically in a bag, however, some machines also dispense in bulk form directly to the consumer's receptacle.

These standalone ice dispensers are great for consumer and owner alike. Once the device is properly installed, there is no need for human involvement in the sales process so that the consumer can buy ice day or night and the owner has a revenue stream with relatively little operating expenses.

In order for a standalone ice dispenser to be efficient, the machine must make a substantial amount of ice, which ice is stored in an appropriate storage receptacle within the machine's housing. Advance manufacture of a large amount of ice assures that sufficient quantizes of ice are available for sale during peak purchase periods. Once ice is purchased, the ice is brought to the weighing and dispensing section of the device by an advancing system. The problem with current standalone ice dispensers is that the advancing system tends to be relatively complex in design and construction. This complexity increases the overall manufacturing cost of the device. Additionally, due to this complexity of the advancing system, the device is more prone to failure. Increased failure rates result in increased operating costs due to the need to have frequent service visits to each device to maintain proper operation. Additionally, should the device malfunction, the machine may loose a substantial amount of revenue stream until the problem is resolved ay the next service visit which may be relatively distant in the future.

What is needed is a standalone ice dispenser that has a relatively simple ice storage and advancing system so that the overall dispenser is relatively less complex in design and thus less expensive to manufacture. Additionally, by having a simple storage and advancing system, service visits can be less frequent in order to reduce the operating expenses of the device and in order to reduce potential revenue robbing down time of the dispenser.

SUMMARY OF THE INVENTION

The standalone ice dispenser of the present invention addresses the aforementioned needs in the art by providing a standalone ice dispenser that sells ice at anytime without operator involvement, which dispenser has a relatively simple ice storage mechanism as well as a relatively simple ice advancing system between the storage mechanism and the dispensing mechanism. Simplicity in design of the storage and advancing systems allows for a less complex dispenser thereby allowing for a relatively less expensive machine. By simplifying the storage and advancing systems, the owner of the device is able to schedule service visits less frequently, thereby decreasing the overall operating costs and increasing the up time of the machine.

The standalone ice dispenser of the present invention is comprised of a housing that has an interior bounded by at least one wall and a chute extending from the interior and through the wall, the chute protruding through the wall to the exterior of the housing. A drum has an internal cavity and an upwardly oriented mouth and is rotatably disposed within the interior of the housing. An, advancing fin is disposed on an inner surface of the internal cavity of the drum. A motor, which may, but not necessarily be electric, is operationally connected to the drum. An ice maker is attached to the housing such that the ice maker receives water and turns the water into ice. Once the ice is made, it is gravitationally discharged from the ice maker into the mouth of the drum. At least one weight sensor may be connected to the drum or a proximity sensor may be positioned proximate the drum or both. When the device is activated, the drum rotates such that the advancing fin causes the ice disposed within the internal cavity of the drum to advance out of the mouth and fall into the chute. When a sufficient quantity of ice has been dispensed from the drum, the drum discontinues rotating. The weight sensor measures the weight of the drum so that when the weight of the drum is below a lower limit, the ice maker is activated and when the weight of the drum is above an upper limit, the ice maker is deactivated. If a proximity sensor is used, the proximity sensor determines the volume of ice in the drum and when the volume of ice in the drum is below a lower limit, the ice maker is activated and when the volume of ice in the drum is above an upper limit, the ice maker is deactivated. A bagging unit may be disposed between mouth of the drum and the chute such that the bagging unit causes the ice falling out of the mouth to be received within a bag with the bag and ice being delivered into the chute. The bagging unit comprises a hopper that has a first trap door. A bag rack receives a plurality of bags and is located below the hopper. A first air cylinder has a plurality of suctions cups on a distal end thereof. A second trap door is pivotally attached to the housing and is located below the bag rack. The first air cylinder extends toward the bag rack such that the suction cups suctionally engage a side of the bag and thereafter the first air cylinder retracts thereby opening the bag. The ice falling out of the drum falls into the hopper and once the hopper is full, the first trap door opens, causing the ice to fall into the open bag below the hopper. Once the bag is full, the second trap door, upon which the bag and ice sit, pivots causing the bag to slide off of the second trap door and into the chute. A pair of guides is provided such that each is rotatably attached to the housing and such that the guides guide the ice falling from the hopper into the open bag. A second air cylinder is attached to the second trap door in order effect rotation of the second trap door. The first trap door is controlled by a third air cylinder. A payment system receives a payment from a user prior to dispensing of the ice.

BRIEF DESCRIPTION OF THE DRAWINGS

Similar reference numerals refer to similar parts throughout the several views of the drawings.

DESCRIPTION OF THE PREFERRED EMBODIMENT

Figure 1:
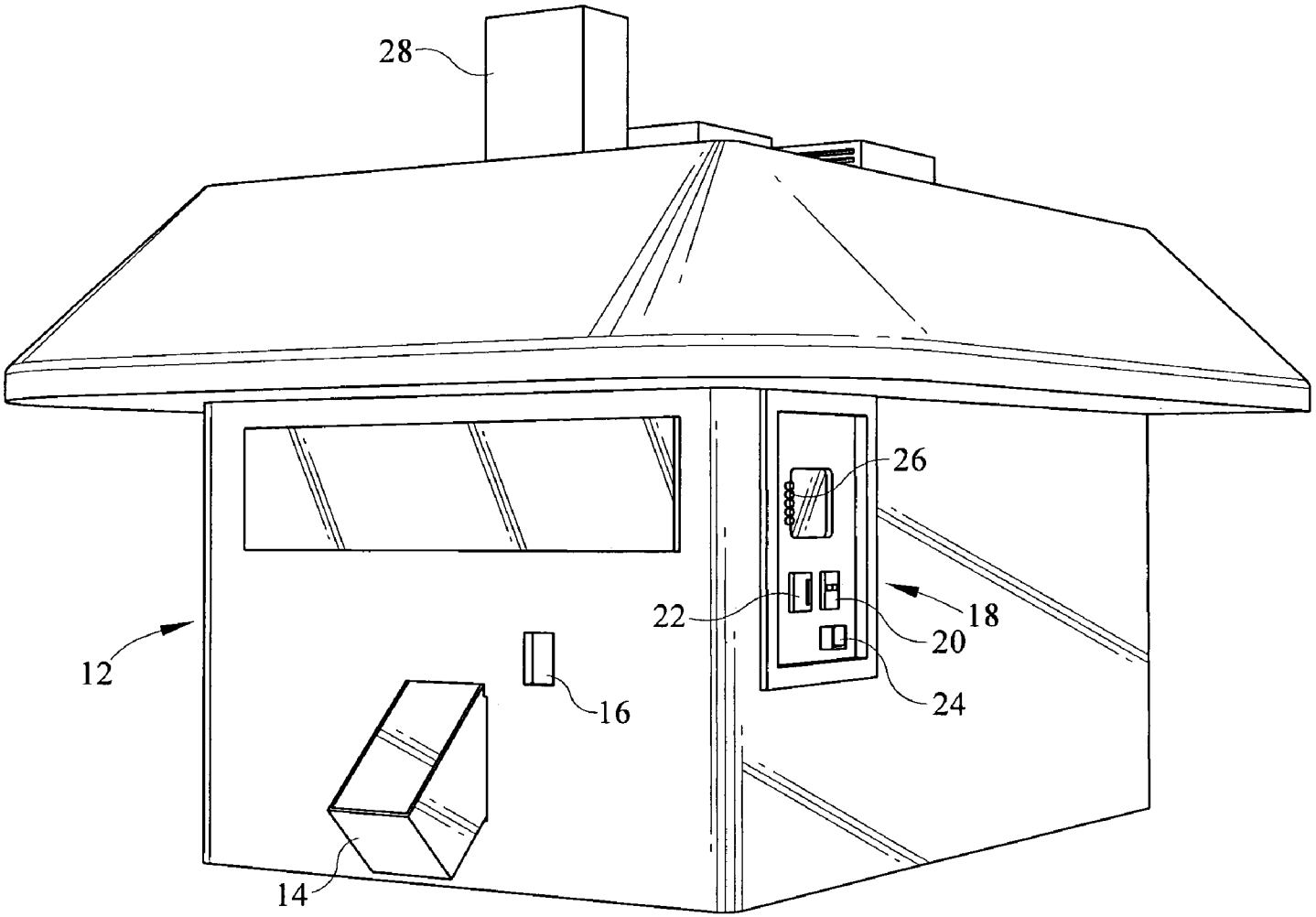
FIG. 1 is a perspective view of the standalone ice dispenser of the present invention.
Figure 2:
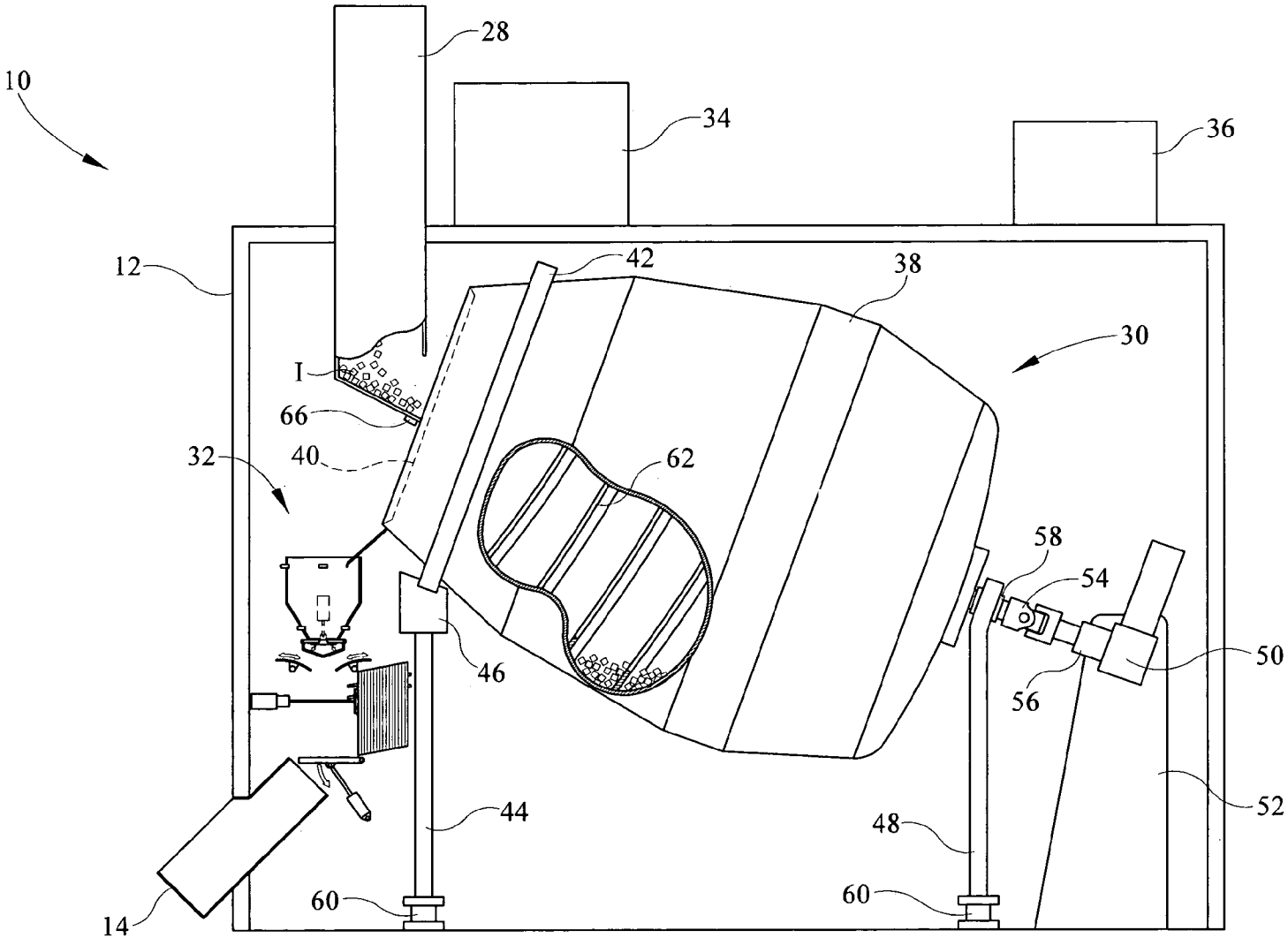
FIG. 2 is a side view, partially cutaway, of the internal workings of the standalone ice dispenser.
Figure 3:
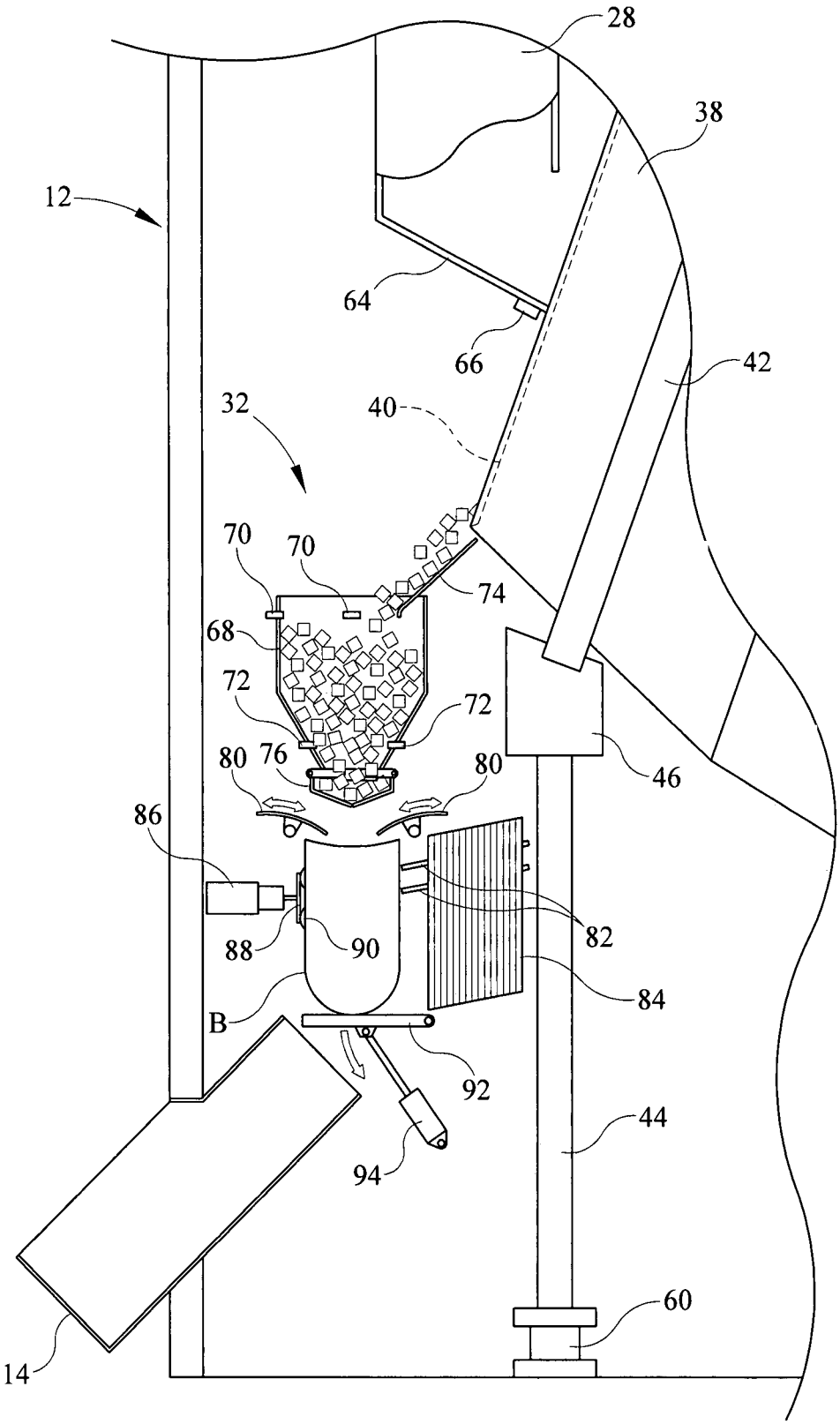
FIG. 3 is a detail view of the internal workings of the standalone ice dispenser at the start of a purchase cycle.
Figure 4:
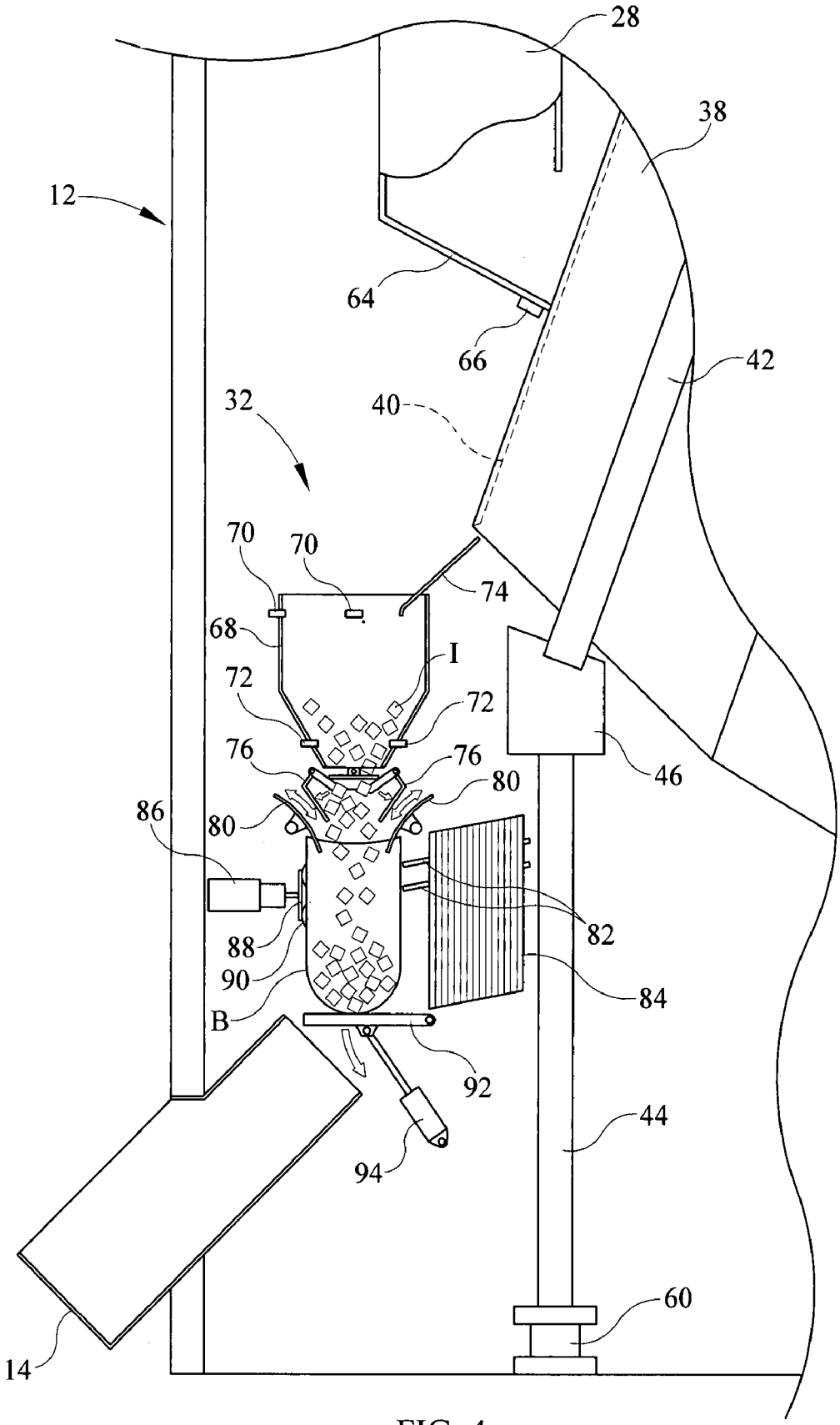
FIG. 4 is a detail view of the internal workings of the standalone ice dispenser during the purchase cycle.
Figure 5:
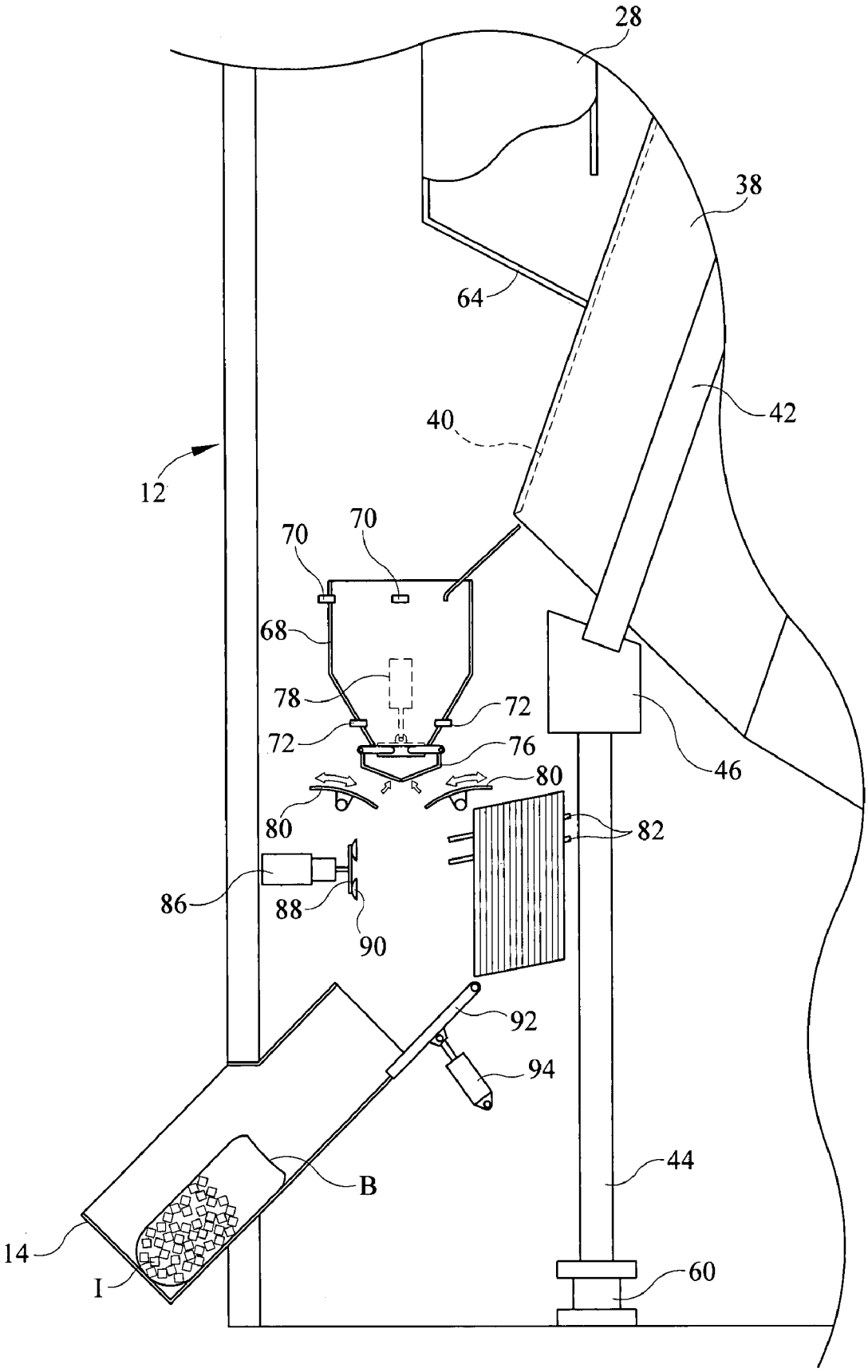
FIG. 5 is a detail view of the internal workings of the standalone ice dispenser at the end of the purchase cycle.

Referring now to the drawings, it is seen that the standalone ice dispenser of the present invention, generally denoted by reference numeral 10, is comprised of a housing 12 that has a dispensing chute 14, the ice I being delivered to the consumer through the chute 14. A storage window 16 holds twist ties that are used to tie the bag B that is dispensed through the chute 14. Also located on the exterior of the housing 12 is a payment center 18 that has a money acceptor of any appropriate design including a bill acceptor 20 and a coin acceptor 22, a change slot 24, and a selection panel 26 for selecting desired quantities and for allowing other interactions with the device 10. The standalone ice dispenser 10 may also have a credit card or debit card acceptance system (not illustrated) that communicates with an appropriate financial clearing house via a cellular telephone (also not illustrated) for accepting such payments from a consumer. Of course the dispensing chute 14 and the payment center 18 can be located on the same side of the housing 12

Located within the housing 12 is an ice maker 28 of any appropriate design, an ice storage system 30 which includes an ice advancing system, and an ice measuring and dispensing system 32. A first cooling unit 34 sits atop the housing 12 and provides cooling for the ice maker 28 while a second cooling unit 36 also sits atop the housing 12 and keeps the inside of the housing 12 at an appropriate temperature in order to keep the produced ice I in top form during storage.

As seen, the ice storage system 30 comprises a cone-shaped drum 38 that has an upwardly oriented open mouth 40 and a mount ring 42. The drum 38 is rotatably mounted on a front post 44 with the mount ring 42 being received within a drive guide 46 located atop the front post 44. The drum 38 also sits atop a rear post 48. An electric motor 50 is located atop a mount 52 proximate the rear post 48 and is connected to the bottom of the drum 38 via a universal joint 54, the universal joint 54 being connected to the motor 50 via a gear box 56. The universal joint 54 passes through a bearing 58 located atop of the rear post 48. Located at the base of each post 44 and 48 are weight sensors 60. Located within the drum 38 are one or more advancing fins 62. The ice maker 28 has a delivery chute 64 that feeds into the open mount 40 of the drum 38. Alternately, or in addition to the weight sensors 60, a proximity sensor 66 may be located at the end of the delivery chute 64 for sensing into the drum 38.

As seen, the ice measuring and dispensing system 32 comprises a hopper 68 that has one or more sensors 70 located at the top and another set of sensors 72 located at the bottom. A hopper chute 74 extends between the open mouth 40 of the drum 38 and the open top of the hopper 68. A trap door 76 is located at the bottom of the hopper 68 and is controlled by a first trap door air cylinder 78 that opens and closes the trap door 76. A pair of guides 80 is rotatably attached to the housing 12 below the trap door 76 of the hopper 68. A pair of downwardly sloping bag racks 82 is attached to the housing 12 and holds a plurality of bags B thereon and has a spring-loaded panel 84 pushing the bags B forwardly toward a bag loading air cylinder 86 that is attached to the housing 12. A grip panel 88 is attached to the end of the bag loading air cylinder 86 and has a plurality of suction cups 90 located thereon. A delivery trap door 92 is pivotally attached to the housing 12 and is located just above the top of the dispensing chute 14. A second trap door air cylinder 94 is attached to the delivery trap door 92 and to the housing 12.

In operation, the standalone ice dispenser 10 is placed at a desired spot and is connected to a source of electrical power and to a source of potable water in the usual way. Once the device 10 is operational, the ice maker 28 produces ice I and as each batch of ice I is made, the ice I drops out of the bottom of the ice maker 28 and is deposited in the drum 38 via the delivery chute 64. Once the drum 38 has a sufficient amount of ice I stored therein, as determined by the weight sensors 60 and/or the proximity sensor 66—the precise amount being dependent on the size of the overall device 10 including the drum 38—the ice maker 28 discontinues producing ice I. A customer goes to the payment center 18 and deposits the appropriate amount of money (or inserts a credit card or debit card if the unit 10 is so configured) and selects either bagged ice I or bulk ice I. If bulk ice I is selected the ice I is advanced from the drum 38, described more fully below, directly to the bulk chute whereat the customer collects the ice I. If bagged ice I is selected, then the ice measuring and dispensing system 32 positions a bag B by having the bag loading air cylinder 86 extend toward the bags B positioned on the racks 84. The suction cups 90 on the grip panel 88 grab a side of a bag B via suction force, and pull this one side of the bag B away from the rack 84 as the bag loading air cylinder 86 retracts. The bag B is now open and ready to receive ice I. The motor 50 activates causing the drum 38 to rotate. As the drum 38 rotates, the advancing fin 62 within the internal cavity of the drum 38 causes ice I to advance upwardly toward and eventually out of the open mount 40 of the drum 38. As the ice I advances out of the drum 38, the ice I falls into the hopper 68 under guidance of the hopper chute 74. Once the sensors 70 at the top of the hopper 68 detect the presence of ice I, due to the hopper 68 being full, the motor 50 discontinues operating so that the drum 38 discontinues rotating so that no further ice I advances out of the drum 38. Now the first trap door air cylinder 78 is activated and extends outwardly causing the trap door 76 to open. This allows the ice I to drop out of the bottom of the hopper 68 and fall into the open bag B. The ice I is guided into the bag B via the guides 80 which also help keep the bag B open during the filling process. Once the lower sensors 72 of the hopper 68 detect the absence of ice I, due to the hopper 68 being empty, the first trap door air cylinder 78 retracts causing the trap door 76 to close. This also causes the second trap door air cylinder 94 to close causing the delivery trap door 92 to rotate downwardly, allowing the bag B with ice I to slide off of the delivery trap door 92 and down into the dispensing chute 14 whereat the bag B is retrieved by the customer. Thereafter, the second trap door air cylinder 94 extends returning the delivery trap door 92 to its ready position. The device 10 is now ready for a new cycle.

Once the weight sensors 60 at the base of the posts 44 and 48 sense that the weight of the drum 38 has fallen below a certain level or the proximity sensor 66 senses that the volume of ice I within the drum 38 has fallen below a certain level, the ice maker 28 is again activated in order to restock the drum 38 with ice.

Operation of the various systems is controlled by an appropriate controller (not illustrated) with the various components connected to the controller in the usual way.

While the invention has been particularly shown and described with reference to an embodiment thereof, it will be appreciated by those skilled in the art that various changes in form and detail may be made without departing from the spirit and scope of the invention.

I claim:

1. A dispenser comprising:

a housing having an interior bounded by at least one wall and a chute extending from the interior and through the wall;

a drum having an internal cavity and an upwardly oriented mouth, the drum rotatably disposed within the interior of the housing;

an advancing fin disposed on an inner surface of the internal cavity of the drum;

an ice maker attached to the housing such that the ice maker is adapted to receive water and turn the water into ice, the produced ice gravitationally falling from the ice maker into the mouth of the drum;

a bagging unit disposed between mouth of the drum and the chute, such that the bagging unit causes the ice falling out of the mouth to be received within a bag with the bag and ice being delivered into the chute wherein the bagging unit comprises;

a hopper having a first trap door;

a bag rack adapted to receive a plurality of bags;

a first air cylinder having a plurality of suctions cups on a distal end thereof;

a second trap door pivotally attached to the housing and located below the bag rack;

a second air cylinder connected to the second trap door; and wherein the first air cylinder extends toward the bag rack such that the suction cups suctionally engage a side of the bag and thereafter the first air cylinder retracts thereby opening the bag and such that the ice falling out of the drum falls into the hopper and once the hopper is full, the first trap door is opened causing the ice to fall into the open bag below the hopper and once the bag is full, the second air under causes the second trap door to pivot causing the bag to slide off of the second trap door and into the chute; and wherein when the device is activated, the drum rotates such that the advancing fin causes the ice disposed within the internal cavity of the drum to advance out of the mouth and fall into the chute and such that when a sufficient quantity of ice has been dispensed from the drum, the drum discontinues rotating.

2. The dispenser as in claim 1 wherein the drum is rotated via a motor that is operationally connected to the drum.

3. The dispenser as in claim 1 further comprising a proximity sensor located proximate the mouth of the drum such that the proximity sensor measures the volume of ice within the drum so that when the volume of ice within the drum is below a lower limit, the ice maker is activated and when the volume of ice within the drum is above an upper limit, the ice maker is deactivated.

4. The dispenser as in claim 1 further comprising a pair of guides, each rotatably attached to the housing such that the guides guide the ice falling from the hopper into the open bag.

5. The dispenser as in claim 1 it wherein the first trap door is controlled by a third air cylinder.

6. The dispenser as in claim 1 further comprising a payment system that receives a payment prior to dispensing of the ice.

7. A dispenser comprising:

a housing having an interior bounded by at least one wall and a chute extending from the interior and through the wall;

a drum having an internal cavity and an upwardly oriented mouth rotatably disposed within the interior of the housing;

an advancing fin disposed on an inner surface of the internal cavity of the drum;

a motor that is operationally connected to the drum;

an ice maker attached to the housing such that the ice maker is adapted to receive water and turn the water into ice, the produced ice gravitationally falling from the ice maker into the mouth of the drum;

a proximity sensor located proximate the mouth of the drum;

a bagging unit disposed between mouth of the drum and the chute, such that the bagging unit causes the ice falling out of the mouth to be received within a bag with the bag and ice being delivered into the chute wherein the bagging unit comprises;

a hopper having a first trap door;

a bag rack adapted to receive a plurality of bags;

a first air cylinder having a plurality of suctions cups on a distal end thereof;

a second trap door pivotally attached to the housing and located below the bag rack;

a second air cylinder connected to the second trap door; and wherein the first air cylinder extends toward the bag rack such that the suction cups suctionally engage a side of the bag and thereafter the first air cylinder retracts thereby opening the bag and such that the ice falling out of the drum falls into the hopper and once the hopper is full, the first trap door is opened causing the ice to fall into the open bag below the hopper and once the bag is full, the second air cylinder causes the second trap door to pivot causing the bag to slide off of the second trap door and into the chute; and wherein when the device is activated, the drum rotates such that the advancing fin causes the ice disposed within the internal cavity of the drum to advance out of the mouth and fall into the chute and such that when a sufficient quantity of ice has been dispensed from the drum, the drum discontinues rotating and such that the proximity sensor measures the volume of ice in the drum so that when the volume of ice in the drum is below a lower limit, the ice maker is activated and when the volume of ice in the drum is above an upper limit the ice maker is deactivated.

8. The dispenser as in claim 7 further comprising a pair of guides, each rotatably attached to the housing such that the guides guide the ice falling from the hopper into the open bag.

9. The dispenser as in claim 7 wherein the first trap door is controlled by a third air cylinder.

10. The dispenser as in claim 7 further comprising a payment system that receives a payment prior to dispensing of the ice.

* * * * *